US005284023A

United States Patent [19]

Silva et al.

[11] Patent Number: 5,284,023

[45] Date of Patent: Feb. 8, 1994

[54] REACH-IN COOLER WITH WINDOW

[75] Inventors: Robert K. Silva, Two Rivers; Kenneth L. Kaiser, Manitowoc, both of Wis.

[73] Assignee: The Manitowoc Company, Inc., Manitowoc, Wis.

[21] Appl. No.: 68,402

[22] Filed: May 27, 1993

Related U.S. Application Data

[60] Division of Ser. No. 882,462, May 12, 1992, which is a continuation-in-part of Ser. No. 589,929, Sep. 28, 1990, Pat. No. 5,199,273.

[51] Int. Cl.[5] ..... F25B 45/00

[52] U.S. Cl. ..... 62/77; 62/448; 312/236

[58] Field of Search ..... 62/440, 448, 441, 444, 62/447, 77; 312/236, 407

[56] References Cited

U.S. PATENT DOCUMENTS

| | | | |
|---|---|---|---|
| 1,789,913 | 1/1931 | Swezey . | |
| 2,247,904 | 7/1941 | Brace . | |
| 2,462,115 | 2/1949 | Luecke . | |
| 2,466,876 | 4/1949 | Brouse . | |
| 2,496,492 | 2/1950 | Prosek . | |
| 2,554,290 | 5/1951 | Becker . | |
| 2,591,178 | 4/1952 | McAdam . | |
| 2,610,473 | 9/1952 | Chovanec . | |
| 2,671,603 | 3/1954 | Bauer . | |
| 2,914,927 | 12/1959 | Corhanidis . | |
| 3,116,614 | 1/1964 | King . | |
| 3,206,943 | 9/1965 | Rice et al. . | |
| 3,327,427 | 6/1967 | Cornelius . | |
| 3,411,569 | 11/1968 | Hildreth . | |
| 3,433,031 | 3/1969 | Scheitlin et al. . | |
| 3,708,997 | 1/1973 | McLaughlin . | |
| 3,712,078 | 1/1973 | Maynard et al. | 62/448 |
| 3,714,795 | 2/1973 | Fowell et al. . | |
| 4,223,482 | 9/1980 | Barroero et al. . | |
| 4,416,122 | 11/1983 | Johnson | 62/448 |
| 4,902,549 | 2/1990 | Bright et al. . | |
| 4,941,289 | 7/1990 | Rolek . | |

OTHER PUBLICATIONS

Three Traulsen & Co., Inc. drawings showing a roll-in refrigerator with a door having a window therein. Traulsen represents that the unit with the window in the door has been on sale since 1980.

Cover page and p. 10 of the 1991 Annual Report for the Manitowoc Company, Inc. showing the reach-in cooler disclosed in application Ser. No. 07/589,929. The reach-in cooler was on sale more than one year prior to the filing date of the above-captioned application.

Manitowoc Ice Cube Machine brochure, 16 pages, copyright 1988.

Continental Refrigerator Corporation brochure, 2 pages (date unknown).

Proofing Cabinets (Japan)-Heating cabinets used in baking applications; the cabinet doors have porthole windows therein (date unknown).

Residential Refrigerators (Italy)-Compartmentalized refrigerators having 4-5 transparent (clear plastic) doors (1989-1990).

*Primary Examiner*—John M. Sollecito

*Attorney, Agent, or Firm*—Willian Brinks Hofer Gilson & Lione

[57] ABSTRACT

A cabinet for a reach-in cooler includes at least one door and a window located within the at least one door. The window is sized to be no larger than one third the surface area of the door.

9 Claims, 8 Drawing Sheets 10
20
21
22
22
24
25
26
28
28
50
53
62
64
70
81
90
108
108
112
5
5

10
20
21
22
22
24
26
27
27
28
28
3
3
4
4
50
104
108
108

REACH-IN COOLER WITH WINDOW

This application is a division of application Ser. No. 07/882,462, filed May 12, 1992, which is a continuation-in-part of application Ser. No. 07/589,929, filed Sep. 28, 1990, now U.S. Pat. No. 5,199,273, issued Apr. 6, 1993.

BACKGROUND OF THE INVENTION

The present invention generally relates to cabinets for reach-in coolers, and more particularly to a cabinet door having a window for viewing the contents of the cabinet, but minimizing heat loss to the environment.

Refrigerators and freezers are usually designed without windows to minimize the heat loss to the outside environment. The contents of household refrigerator and freezer units are sufficiently known, and energy conservation is sufficiently important, to negate the need for continuous viewing access to the interior of the units. In commercial and merchandiser designs, however, refrigerators and freezers often include glass doors to allow patrons to see the types and brands of food stocked therein. While providing a convenience to patrons of commercial establishments, these glass doors allow significant heat loss to occur. Examples of such doors are shown or described in U.S. Pat. Nos. 4,416,122 to Johnson, 4,941,289 to Rolek, and 3,712,078 to Maynard. Additionally, storage and food service coolers used, for example, in grocery store storage rooms and restaurants usually do not include glass doors. While the absence of glass doors minimizes heat loss to the environment, lack of knowledge regarding the contents of the coolers may actually cause a greater heat loss than would providing the storage cooler with a glass door. For instance, in a grocery store, and most especially in a restaurant, employees often open and close cooler doors while looking for a certain food or other stock. Due to the constant flow of stock into and out of storage coolers, it may be impractical for one to reliably know the contents of a storage cooler at any given time. This is especially true when shift work is involved at the establishment. In that case, employees on one shift may have no idea what types of food or other stock was used or stocked, or where the stock was placed, on an earlier shift. Also, when numerous identical or similar coolers are located side-by-side, one may forget in which cooler it was that one placed a food or other stock. Therefore, to determine whether a certain food or other stock is located within a storage cooler, one must open the cooler door and look into the cooler. Opening the cooler door allows refrigerated air to escape from the cooler to the environment, thereby increasing the amount of energy required to maintain the cooler at the necessary temperature. This problem is exacerbated when there are numerous storage coolers within which stock is stored.

The use or absence of glass doors in merchandiser, food service and household refrigeration units provokes divergent problems in the refrigeration art. For example, while it is desirable to have continuous viewing access to the interior of refrigeration units, the heat loss associated with glass doors makes their implementation impractical in household and food service units, and a necessary inefficiency in merchandiser units. Thus, it is desirable to develop a refrigerator and freezer cabinet that will permit one to view the interior thereof, without excessive heat loss from the cabinet to the environment.

SUMMARY OF THE INVENTION

According to a first aspect of the present invention, a cabinet for a reach-in cooler is provided including at least one door, and a window located within the door and sized to be no larger than one third of the door surface area. The window is preferably sized and positioned to be no larger than necessary and still permit viewing of the confines of the reach-in cooler. Most preferably, the transparent area of the window will be in the range of about 10% to 30% of the surface area of the door.

The first aspect of the present invention is particularly useful in connection with the reach-in cooler disclosed in our parent application. Thus, according to a second aspect of the present invention, a reach-in cooler is provided including an insulated cabinet member with walls having at least one door opening and a door with at least one window sized to be no larger than one third of the door surface area, and a floor completing the cabinet body, but with an open roof area; an insulated roof member configured to close the open roof area of the cabinet; a refrigeration system comprising a condenser and a compressor mounted on the top of the roof member, an evaporator mounted on the bottom of the roof member and refrigeration lines connecting the evaporator to the condenser and the compressor running through the insulated roof member; and sealing means for providing an air tight seal between the cabinet member and the roof member when the roof member is placed to close off the open roof area of the cabinet.

The foregoing aspects of the present invention allow continuous viewing of the interior of refrigeration units without the need for opening the units' doors and reduce the heat loss from the units to the outside environment. Thus, commercial reach-in coolers may utilize the present invention to lower the amount of heat loss encountered with the use of large, conventional glass doors, without overly restricting the view of the units' interiors.

These and other advantages, as well as the invention itself, will best be understood in reference to the attached drawings, a brief description of which follows.

DETAILED DESCRIPTION OF THE DRAWINGS AND PREFERRED EMBODIMENTS OF THE INVENTION

The present invention can be utilized with many reach-in cooler designs, but it will be described in connection with its preferred embodiment, which is a reach-in cooler as disclosed in our parent application. As disclosed therein, the reach-in cooler may be either a one, two or three door model. The two-door model will be discussed in detail, and is shown in FIGS. 1-7. The one-door and three-door models are shown respectively in FIGS. 8 and 9.

As used herein, the term "reach-in cooler" is used generally to include both refrigerators and freezers. The preferred embodiment of the present invention, while preferably directed to reach-in coolers designed for use in commercial and storage locations, also applies to refrigerators and freezers that are used in the home.

Figure 2:
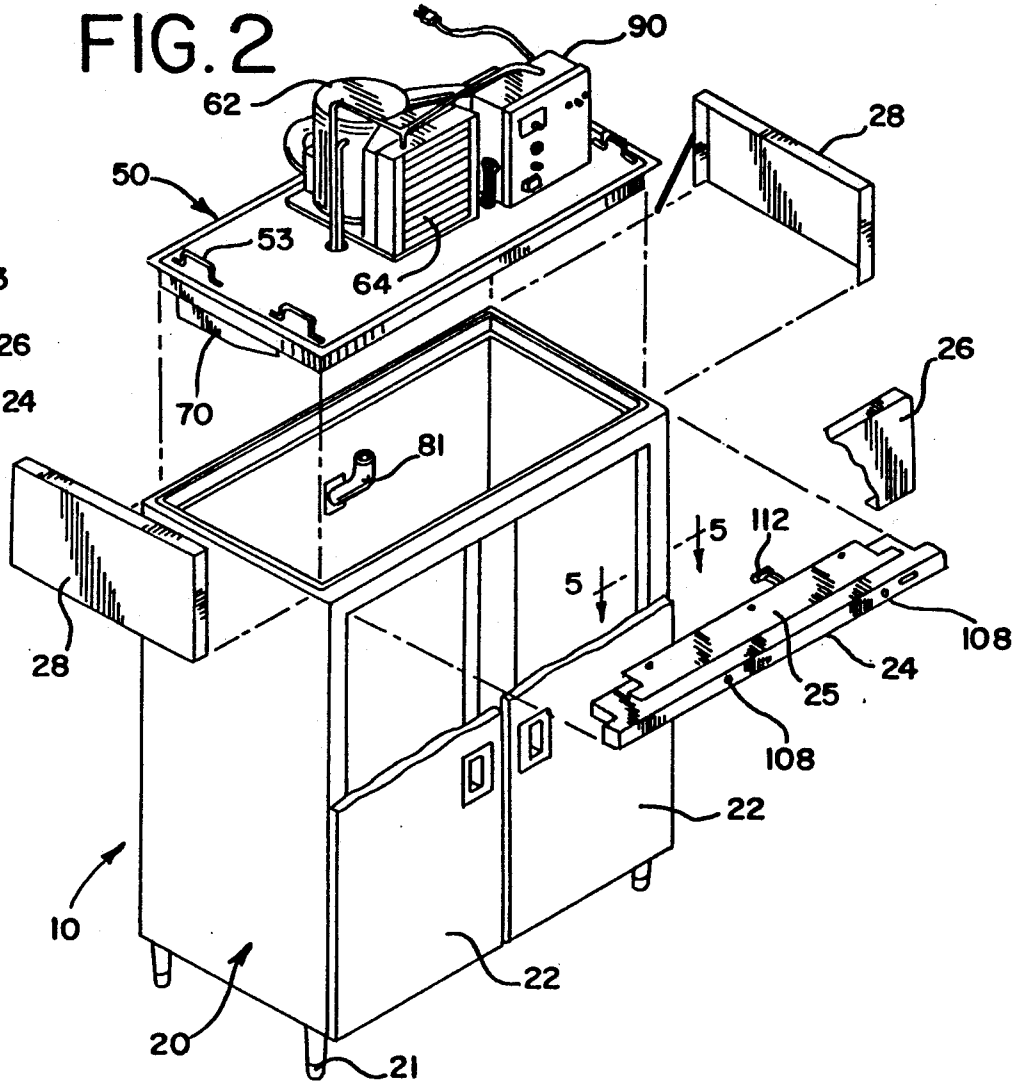
FIG. 2 is an exploded perspective view of the reach-in cooler of FIG. 1.
Figure 1:
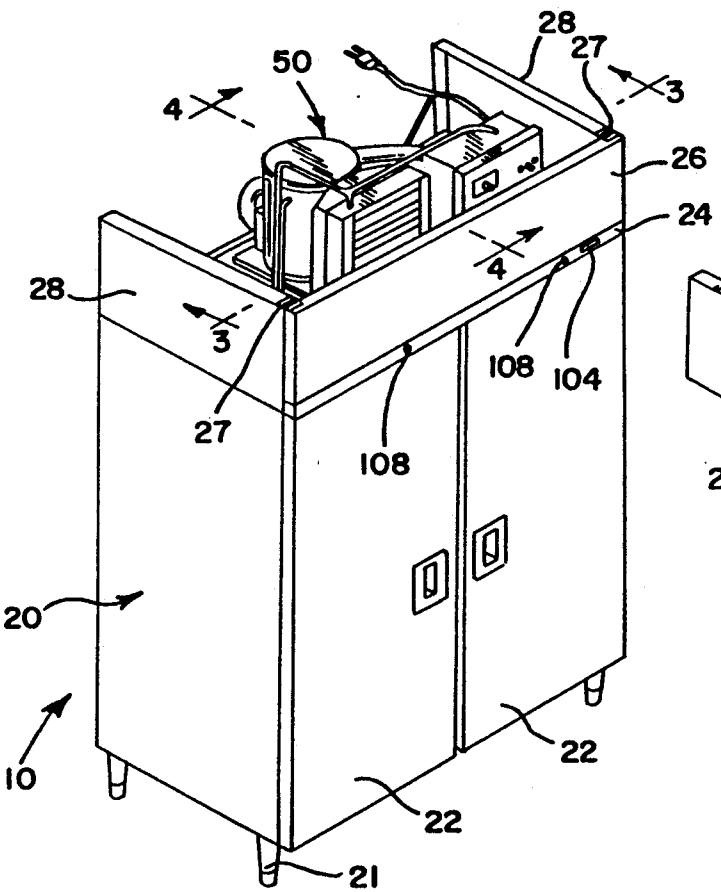
FIG. 1 is a perspective view of a two-door, reach-in cooler of the present invention.

As shown in FIG. 2, the two-door, reach-in cooler 10 includes three major components, a cabinet member 20, a roof member 50 and a refrigeration system mounted to the roof member 50. The cooler 10 is fitted with a number of additional components, including legs 21, doors 22, an electrical wire channel 24, a channel cover plate 25, and a front top panel member 26 hinged by hinges 27 (FIG. 4 and 7) to two top side panel members 28. The top panel members 26 and 28 serve an aesthetic purpose, hiding the refrigeration system mounted on the roof member 50. Wire gussets 17 hold the top side panel members 28 upright at the rear of cooler 10 since the back and top is open and there is otherwise nothing to keep the panel members 28 square with the cabinet 20. These and other additional components will be discussed in more detail below.

The cabinet member 20 includes side walls having, in this case, two door openings on the front side wall, and a floor. However, the roof area of the cabinet member 20 is open, but configured to be closed by "dropping in" the roof member 50.

Figure 3:
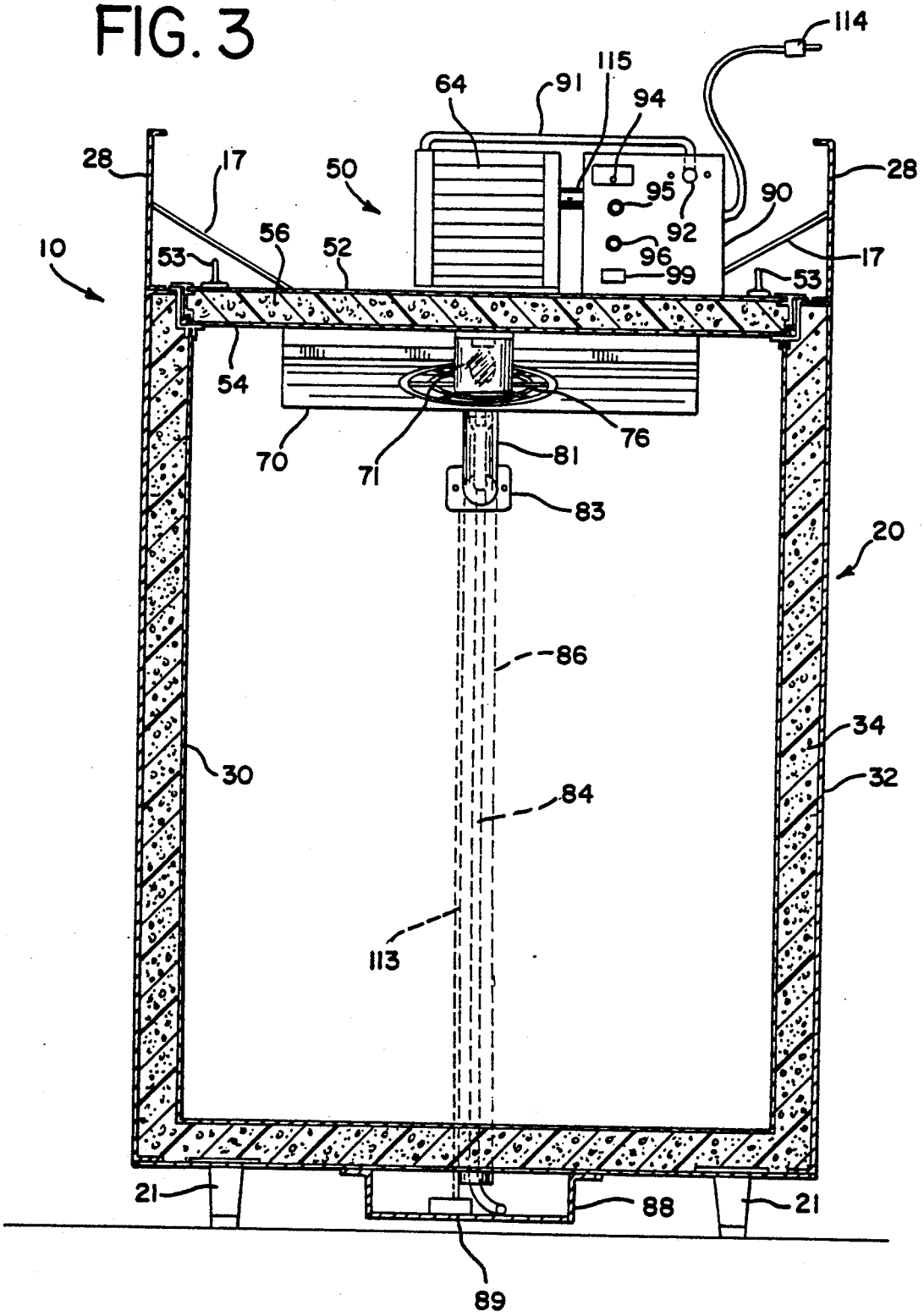
FIG. 3 is a sectional view taken along line 3—3 of FIG. 1.

As best seen in FIG. 3, the cabinet member 20 is constructed with an inside sheet metal layer 30 and an outside sheet metal layer 32, with a layer of insulation 34 between the sheet metal layers. Both the inside and outside sheet metal layers 30 and 32 are made of several pieces of sheet metal fastened together, the joints not being shown for sake of simplicity, and because this type of cabinet construction is routinely used to make refrigerators and freezers.

Figure 11:
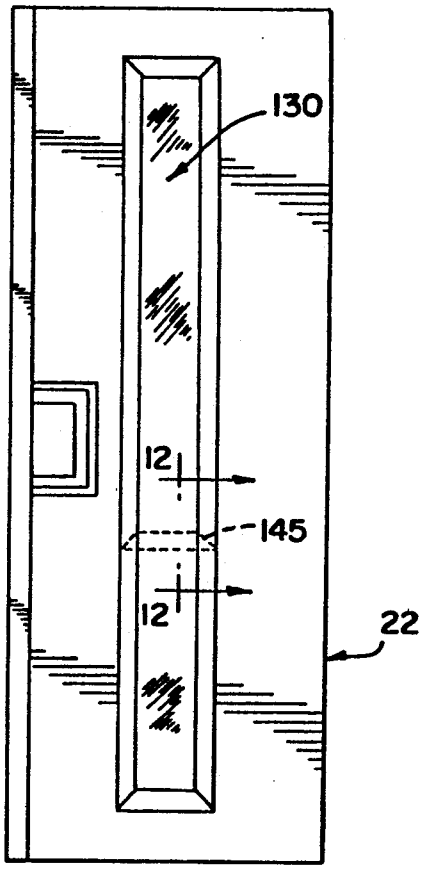
FIG. 11 is a front view of the right-side door shown in FIG; 9, including a preferred embodiment of a window for viewing the interior of the reach-in cooler.

The side walls and the doors 22 of the cabinet member 20 may include windows 130 for viewing the interior of the reach-in cooler 10. The windows 130 are sized to be no larger than one third of the door 22 surface area. Preferably, as shown in FIG. 11, the viewing window 130 is rectangularly shaped and is located within the door 22 in a symmetrical fashion, that is, the centerlines of the window 130 and the door 22 are identically located. To minimize heat-loss, the window 130 is sized to be no larger than necessary to permit a person to observe the confines of the reach-in cooler 10. The preferred embodiment of the window 130 is about nine times as long as it is wide. Additionally, the window 130 preferably has a transparent area in the range of about 10% to 30% of the surface area of the door 22.

Alternately, as also shown in FIG. 11 by dashed lines 145, the window 130 may be located within the door 22 in a non-symmetrical fashion, that is, the long sides of the window 130 are parallel to the side walls of the cabinet 20 and the centerline of the window 130 is positioned above the centerline of the door 22. The non-symmetrical placement of the window 130 also allows one to view the interior of the reach-in cooler 10. Specifically, the length of the window 130 may be fashioned such that persons of average height are able to view the floor of the cabinet member 20 without the window 130 extending the length of the door 22. The alternate embodiment of the window 130 is about six times as long as it is wide. Additionally, the window 130 has a transparent area in the range of about 10% to 20% of the surface area of the door 22.

The preferred embodiment of the window 130, while having a larger surface area than the alternate embodiment, does not allow heat loss to the environment significantly above that of the alternate embodiment. Specifically, tests have shown that a refrigeration unit is able to maintain a reach-in cooler 10 of the preferred embodiment at the same temperature as that of the alternate embodiment without the additional expenditure of an appreciable amount of energy. Furthermore, the preferred embodiment of the window 130 has an additional advantage over the alternate embodiment in that cabinet doors 22 provided with the preferred embodiment can be used as either right-handed doors or left-handed doors.

Figure 12:
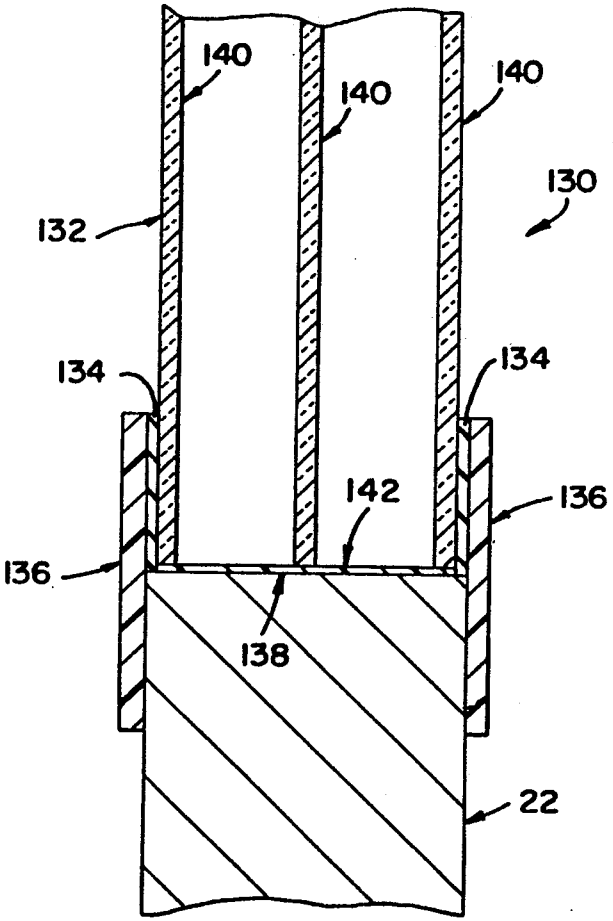
FIG. 12 is a partial sectional view taken along line 12—12 of FIG. 11.

As shown in FIG. 12, to minimize heat-loss therethrough, the window 130 preferably has a triple-pane construction 132. The panes 140 may comprise any transparent material. A seal is formed along the interior and exterior boundaries between the door 22 and the window 130 by means of a gasket 134 and trim 136 combination. The trim portions 136 are attached to the interior and exterior surfaces of the door 22 in any suitable manner. The gaskets 134 are disposed between the trim portions 136 and the window 130 to complete the seal. The gaskets 134 and the trim portions 136 may comprise any suitable material. Preferably, however, the gaskets 134 are formed of urethane and the trim portions 136 are formed of PVC. An additional seal 142 is positioned along the interface 138 between the door 22 and the window 130. This seal is preferably formed of butyl rubber.

Figure 5:
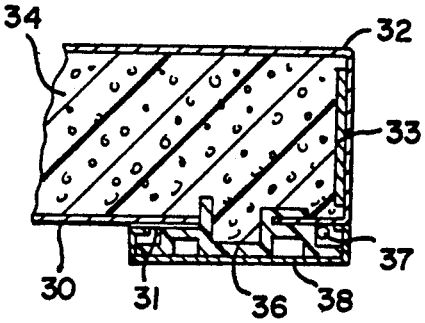
FIG. 5 is a partial sectional view taken along line 5—5 of FIG. 2.

The outside layer 32 and inside layer 30 are connected by a breaker strip 36 at the door opening, as best shown in FIG. 5. The breaker strip 36 is molded from plastic and prevents conduction of heat between the inside layer 30 and outside layer 32. A heater wire 37 is placed in contact with the outside layer 32 around the perimeter of the door opening. The heater wire 37 is activated when the cabinet is used as a freezer. The heater wire 37 prevents frost buildup at the door opening. The breaker strip 36 and heater wire 37 are covered by a molding 38 which snaps in place over the breaker strip 36 to present a finished appearance to the door opening. A piece of double-sided tape 31 is used to hold the inside sheet metal layer 30 against the breaker strip 36 until the insulation 34 is in place.

Figure 6:
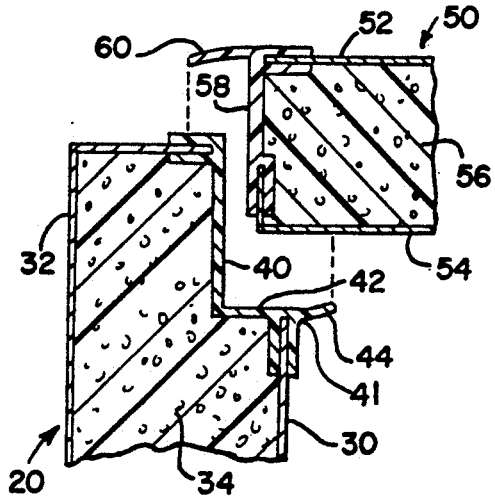
FIG. 6 is a partial sectional view showing the air seals made upon placement of a roof member to close the open roof area of a cabinet member in the reach-in cooler of FIG. 1.

At the open roof area of the cabinet member 20, as best seen in FIG. 6, another breaker strip 40 is used between the inside layer 30 and outside layer 32. As shown, outside layer 32 is folded 90° at the top of the cabinet member 20 to provide a top surface of the cabinet member 20. Breaker strip 40 is a dual durometer plastic extrusion. Most of the breaker strip 40, including the ledge 42 on which the roof member 50 sits, is made of rigid plastic. However, a flexible tip portion 44 protrudes inwardly and upwardly from the breaker strip 40 at the edge of ledge 42. Tip 44 is constructed so that it will seal against the roof member 50 when the roof member 50 sits on the ledge 44.

Also as shown in FIGS. 3 and 6, the roof member 50 is made of a top layer of sheet metal 52, a bottom layer of sheet metal 54, and a layer of insulation 56. A roof perimeter breaker strip 58 connects the top and bottom layers 52 and 54. As with the cabinet roof opening breaker strip 40, the breaker strip 58 is also a dual durometer plastic extrusion. The major portion of the breaker strip 58 is rigid, but a leg 60 extending outwardly at the top of the breaker strip 58 is made of flexible plastic. As shown in FIG. 6, the leg 60 is formed so as to be biased downwardly. In the preferred embodiment, the depth of the ledge 42 matches the thickness of the roof member 50 so that the top surface of the cabinet member 20 is flush with the top layer of sheet metal 52 when the roof member 50 rests on ledge 42. In this manner, the leg 60 provides an air tight seal against the top surface of the cabinet member 20 when the roof member 50 sits on ledge 42.

Thus, when the roof member 50 is in place, either breaker strip 40 with flexible tip 44, or breaker strip 58 with flexible leg 60, constitutes a means for providing an air tight seal between the cabinet member 20 and the roof member 50. In the preferred embodiment shown, the combined system provides double air seals, each made with a dual durometer plastic member.

Figure 4:
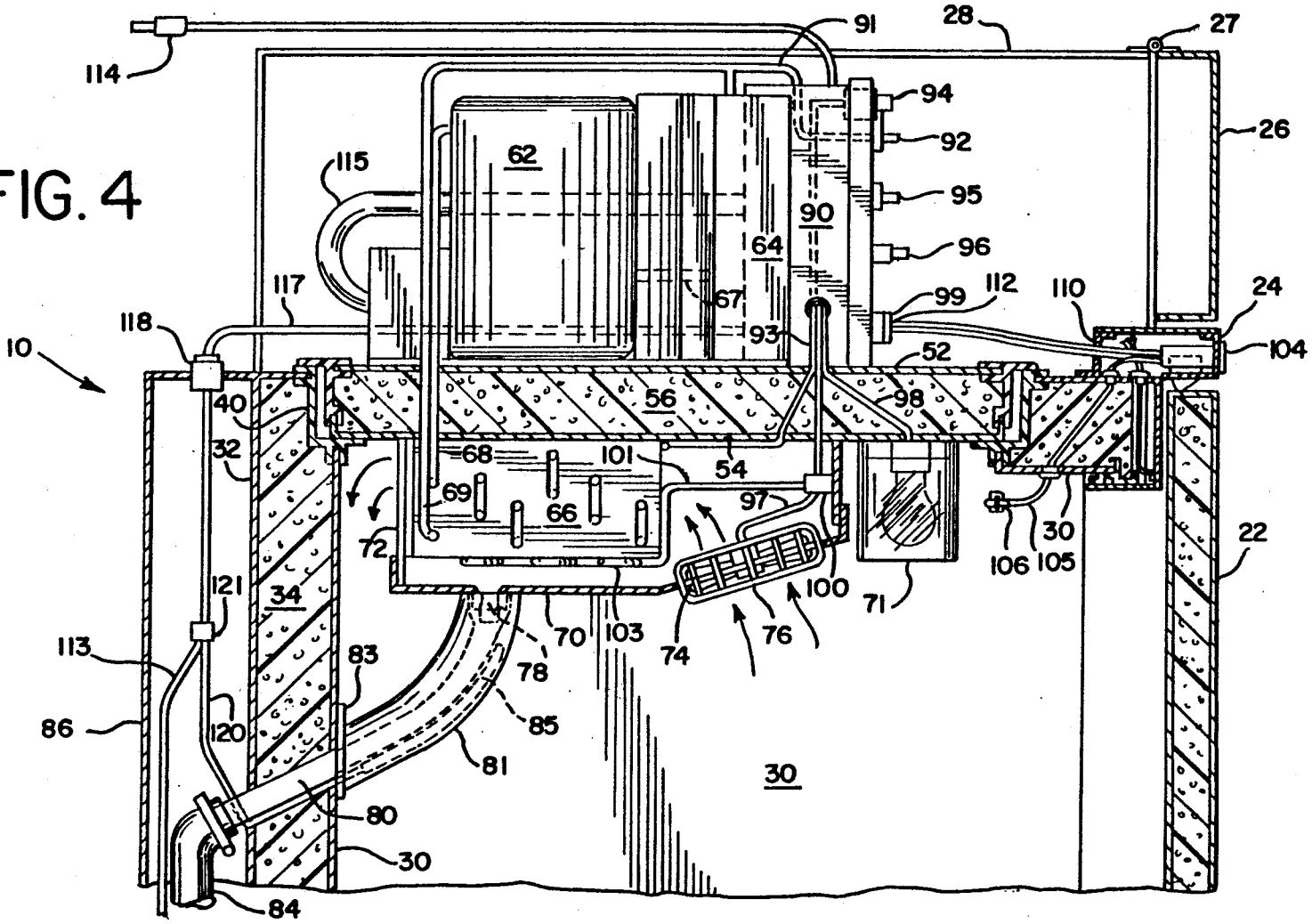
FIG. 4 is a partial sectional view taken generally along line 4—4 of FIG. 1.

As best seen in FIGS. 2 and 4, the refrigeration system includes a compressor 62, a condenser 64 and an evaporator 66. The compressor 62 and condenser 64 are mounted together on the top of the top layer of sheet metal 52 by a suitable frame, also supporting a condenser fan (not shown). The compressor/condenser/fan configuration may be purchased as a unit, as is common in the industry.

As best seen in FIG. 4, the evaporator 66 is mounted to the bottom of the roof member 50. Refrigerant lines 68 and 69 connect the evaporator 66 respectively to the compressor 62 and condenser 64. A refrigerant line 67 (shown in dashed lines) connects the compressor 62 and the condenser 64. The refrigerant lines 68 and 69 run through the layer of insulation 56 as well as the top and bottom sheet metal layers 52 and 54 of roof member 50. Although not shown, the portion of the return line 68 above the roof top layer 52 is preferably covered with insulation.

Also shown in FIG. 4, an evaporator housing 70 made of sheet metal is mounted to the bottom of the roof member 50. The housing 70 encloses the evaporator 66, except for an area on the back side of the evaporator 66, which is open to provide an air outlet 72. A hole 74 is fashioned in the housing 70 as an air inlet. In the preferred embodiment, a fan 76 is placed in the hole 74 to draw air in from the cabinet 20 and force it past the evaporator 66 and out the outlet 72, where it travels down the back side of the cabinet 20 and re-circulates.

As moisture laden air travels past the evaporator 66, condensate or frost will form on the evaporator 66. Housing 70 is therefore fashioned with a condensate outlet 78, which allows the condensate (or frost melted during a defrost cycle) to run out of the housing 70 and into drain tube 80. Shadow breaks (not shown) are preferably formed in the bottom of housing 70 to help direct condensate to the condensate outlet 78.

Drain tube 80 fits through a hole in the back wall of cabinet member 20 and connects to drain hose 84. The drain hose 84 runs down the back of a channel 86 attached to the outside rear wall of the cabinet member 20. The hose 84 may be run into a floor drain or into a condensate evaporation pan 88 heated by heater 89 (FIG. 3) provided with the reach-in cooler 10. Preferably the hose 84 is fitted with a "P" trap (not shown) at its bottom end.

The drain tube 80 is fashioned with a funnel shaped top and positioned such that the condensate outlet 78 mates with funnel shaped top of the drain tube 80 when the roof member 50 is put in place. The tube 80 is held in place and covered by a curved pipe 81. The pipe 81 has a bracket 83 welded to its bottom end with holes for screws used to attach the bracket 83 to the back wall of the cabinet 20. The pipe 81 also covers an electrical heater element 85 which fits up against the portion of the drain tube 80 inside of the cabinet 20. The heater element 85 is used to prevent condensate from freezing inside the drain tube when the cabinet 20 is used as a freezer.

A control box 90 is also mounted on the top of the roof member 50. The control box 90 includes electrical junctions as well as a number of controls, mounted on the front panel of the control box 90. Besides electrical wires, two other lines run into the control box 90. The first line 91 is a high pressure sensor line, which connects to the outlet side of the condenser 64. The other end of line 91 connects to a reset button 92 on the face of the control box. A temperature sensor (not shown) will act to turn off the compressor 62 if the compressor/condenser gets too hot (commonly caused by the condenser fins getting plugged up with dust and lint). The reset button 92 is used to restart the compressor after the temperature sensor turns it off. The high pressure sensor line 91 prevents reset button 92 from being activated if the pressure in the condenser 64 is too high.

The second line 93 is a capillary line that runs between a thermostat in the control box 90, through the roof member 50, and into the evaporator housing 70. Capillary line 93 is preferably in hard contact with the fins on the evaporator 66. The capillary line 93 is used to sense the temperature of the fins, which in turn relates to the temperature of air drawn into the housing 70 from the cabinet 20. The thermostat is connected to a knob 94 on the front of control box 90. The knob 94 is used to set the thermostat to the desired cabinet temperature.

The front of control box 90 also supports two switches 95 and 96. Switch 95 is an on-off switch for the entire unit. Switch 96 is an on-off switch for the door heater wires 37. Switch 96 is only included on the refrigerator systems. When the cabinet 20 is used as a refrigerator, the owner can use switch 96 to operate heater wires 37 when condensate forms at the door areas. For the freezer units, heater wires 37 are continuously used. A receptacle 99 is also provided on the front of control box 90 to plug in wires from the electrical wire channel 24.

In addition to capillary line 93, two electrical lines also run from the control box 90 through the roof member 50. The first line 98 connects to a light 71 mounted next to the evaporator housing 70 on the bottom of the roof member 50. The second line 97 connects to the fan 76. In the freezer version of the cooler 10, as shown in FIG. 4, line 97 goes to a junction box 100 inside housing 70. A separate electrical line 101 leads from junction box 100 to a calrod heater 103 mounted to the bottom of the evaporator 66. A defrost timer (not shown) activates the calrod heater 103 when the system begins its defrost cycle.

Figure 7:
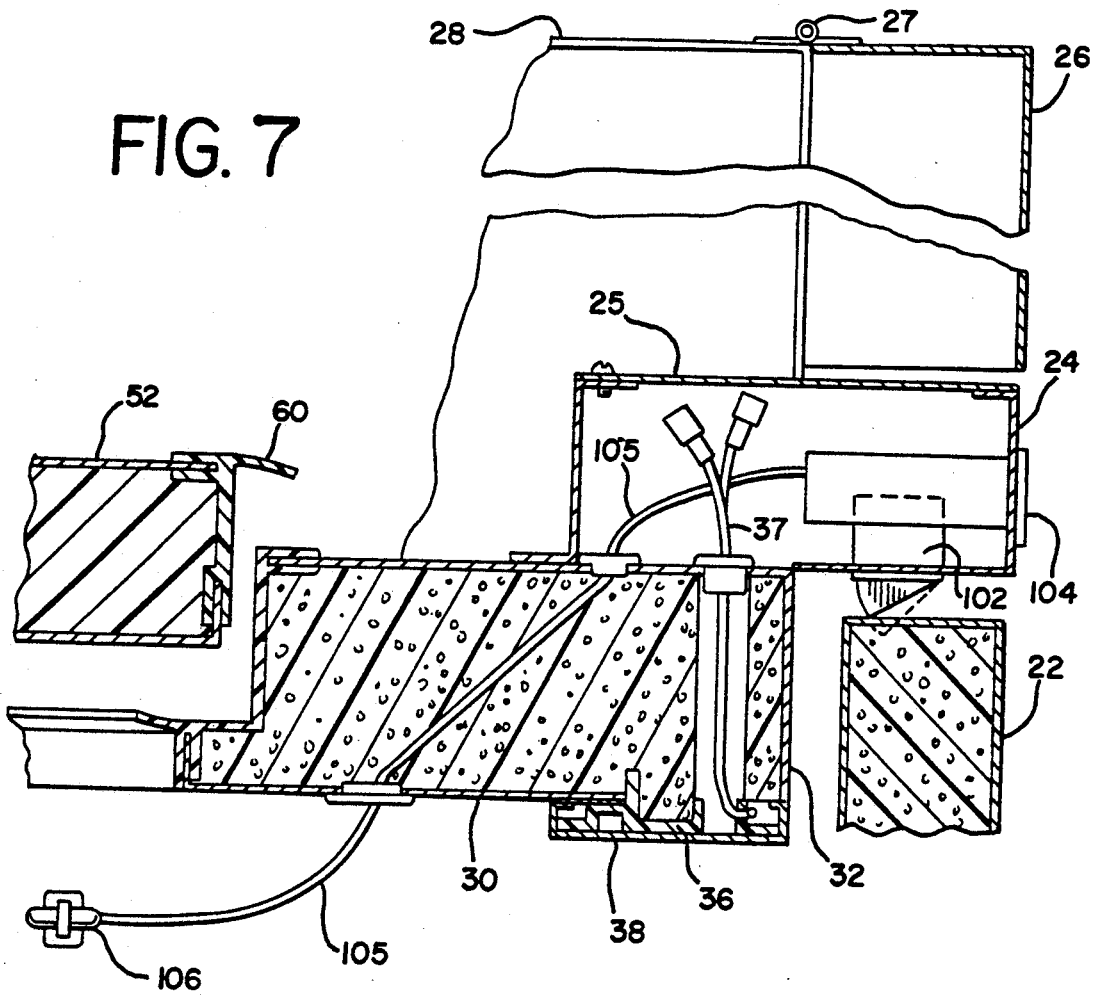
FIG. 7 is an enlarged sectional view showing a portion of the reach-in cooler of FIG. 1 depicted on the far right side of FIG. 4.

The electrical wire channel 24 is mounted over the front wall on top of the cabinet member 20. As best shown in FIG. 7, the channel 24 extends out over the doors 22. Switch 102 is biased against the top of the door 22. When either door 22 is opened, the switch 102 above that door pops open, turning on the light 71. The switches 102 are also part of the circuit used to supply current to the fan 76. As will be evident from the schematic wiring diagram (FIG. 10), if either door 22 is opened, the fan 76 will be turned off.

The channel 24 carries connecting wires for the door heater wires 37 and door switches 102. These wires exit the back of channel 24 through a hole 110 and terminate in a plug 112, as best seen in FIGS. 2 and 4. The plug 112 fits into the receptacle 99 on the front of the control box 90.

The wiring channel 24 also houses a thermometer 104 having a dial visible from in front of the cabinet 20. A capillary line 105 from the thermometer 104 passes through the bottom of the wiring channel 24, through the top wall of the cabinet 20, and across the top side face of the cabinet 20. The capillary line 105 terminates in a bulb 106 attached to the side wall of the cabinet 22 where it can sense the temperature of the air in the cabinet 20.

A key lock 108 (FIGS. 1 and 2) is provided in the channel 24 above each door 22. Activating the lock 108 rotates a mechanical device into a slot (not shown) in the top of the door 22, preventing the door 22 from opening.

Electrical power for the reach-in cooler 10 is supplied to cooler 10 from a wall plug 114 and cord running into the control box 90 (FIG. 4). From the control box 90, power is supplied via conduit 115 to the compressor condenser/fan assembly and via wire 117 to a plug 118 at the top of channel 86. A wire 113 inside of channel 86 provides current to the condensate evaporation heater 89. A connector 121 on wire 113 inside channel 86 is provided to plug in the lead wire 120 of the drain tube heater element 85

Figure 10:
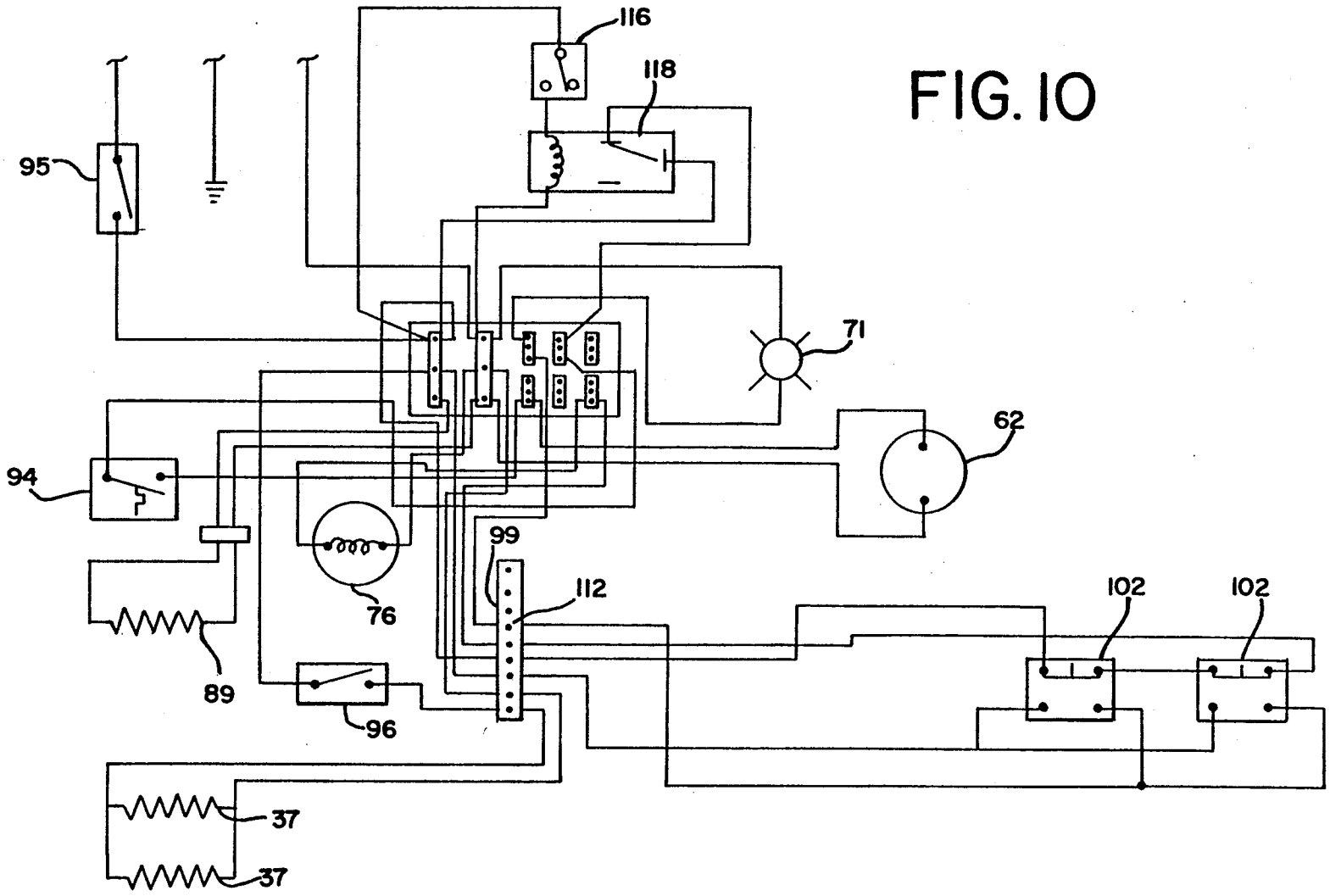
FIG. 10 is a schematic diagram of the electrical system for the reach-in cooler of FIG. 1.

FIG. 10 depicts the wiring between the various components previously described, including the main on-off power switch 95, the temperature control 94, the condensate evaporation pan heater 89, door heater wires 37, door heater switch 96, fan 76, light 71, compressor 62, door switches 102, plug 112 and receptacle 99. Also shown schematically is the high-pressure cut-out 116 that trips relay 118, shutting off power to the compressor 62 if the temperature (and thus pressure) rises too high in the outlet of condenser 64. Not shown on the schematic is the optional wire 120 (FIG. 4) that runs inside of back channel 86 to supply current to the drain tube heater 85, nor wiring for the calrod heater 103 used to defrost the evaporator 66 in the freezer assembly. Necessary other electrical connectors, fuses and the like are not shown for purpose of clarity and because those items are well known in the art.

Figure 9:
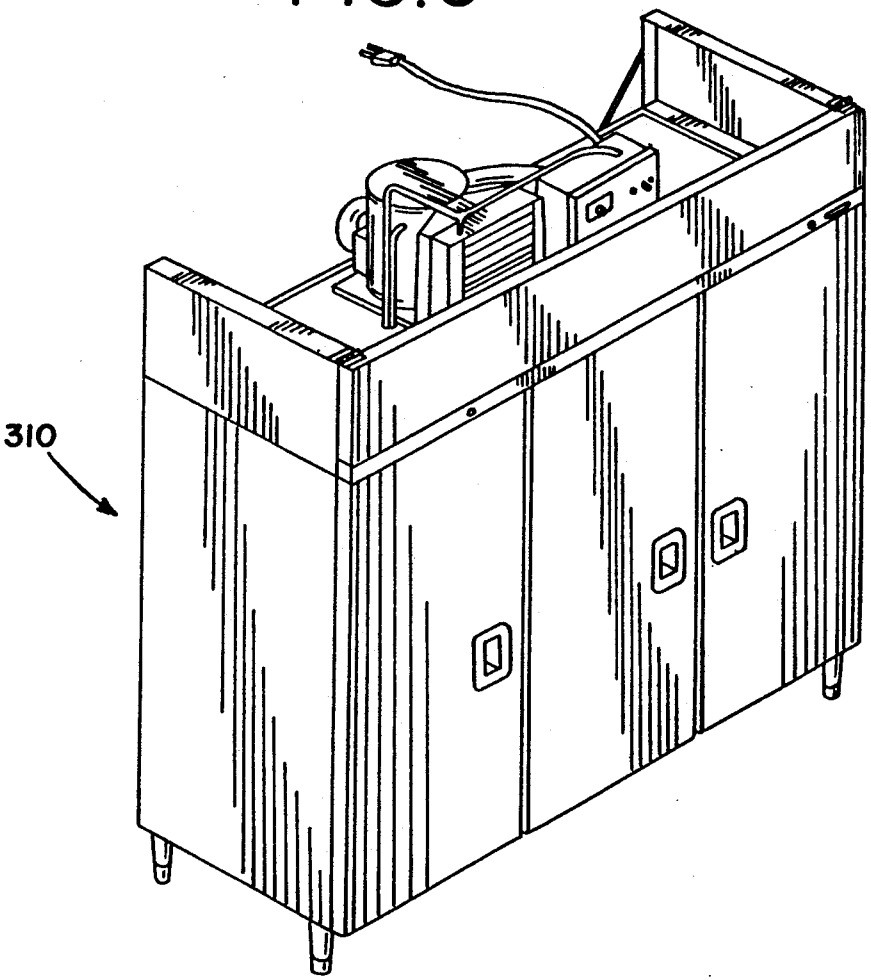
FIG. 9 is a perspective view of a three-door, reach-in cooler of the present invention.
Figure 8:
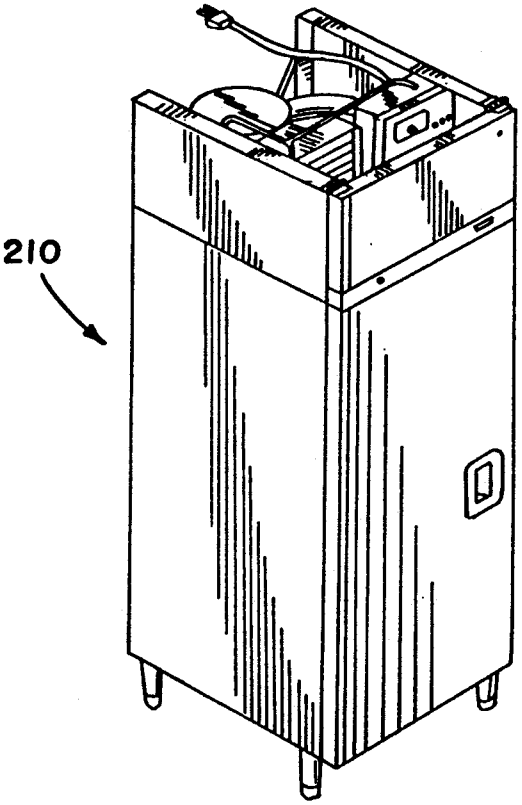
FIG. 8 is a perspective view of a one-door, reach-in cooler of the present invention.

FIG. 8 shows a one-door reach-in cooler 210. It has all the same parts as the two-door cooler 10 shown in the FIGS. 1-7. FIG. 9 shows a three-door reach-in cooler 310 of the present invention. It likewise has all the same parts as the two-door cooler 10 shown in FIGS. 1-7. Of course the size and capacity of the refrigeration system for the coolers 10, 210 and 310 will each differ.

Figure 13:
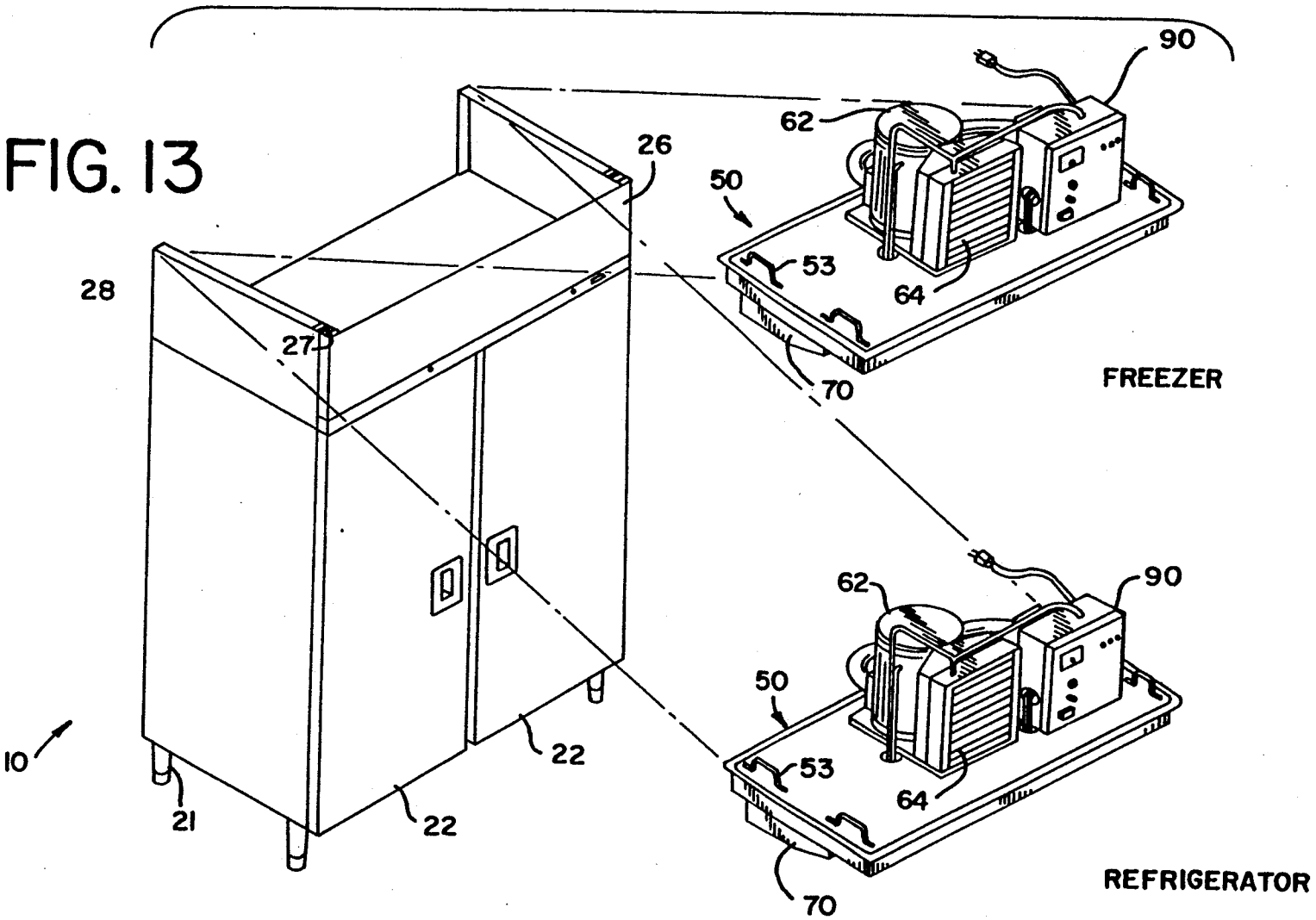
FIG. 13 shows separate removable roof mounted freezer and refrigeration units paired with a single reach in cooler cabinet.

As shown in FIG. 13 a single reach-in refrigerator cabinet is provided with two separate removable and interchangeable roof members each having either a freezer or refrigeration unit mounted thereto. Therefore a distributor will carry two different refrigeration systems for each model (one-door, two-door or three-door) reach-in cooler that the distributor stocks. Thus, if a distributor carries all three cabinet sizes, the distributor will stock six different roof member/refrigeration system combinations, three for making the cabinets into refrigerators and three for making the cabinets into freezers.

The six different roof member/refrigeration assemblies will have the same components (with the exception of the defrost timer and heater 103, drain tube heater 85 and door heater wire switch 96 described above), but will be of different sizes. For example, the system used for a one-door refrigerator reach-in cooler will have the lowest cooling capacity, while the system for a three-door freezer will have the highest capacity. In the case of systems for use of the cabinet 20 as a freezer, the refrigeration system will preferably be sized so as to maintain freezing temperatures (about 0° F.) in the cabinet during normal commercial use. When the cabinet is used as a refrigerator, the refrigeration system will preferably be sized so as to maintain refrigeration temperatures (about 36°-42° F.) during normal commercial use. Also, the number and size of fans 76 will differ. For example, in the preferred embodiment of the invention, the three-door freezer model uses one large fan, but the three-door refrigerator model uses two smaller fans.

In the preferred embodiments, the outside cabinet walls 32 are made of anodized aluminum sheet, except for the bottom, which is preferably 14 gauge steel. The inside walls 30 are made of stucco aluminum, except the floor, which is made of 24 gauge stainless steel. The bottom layer of sheet metal 54 for the roof member 50 is preferably stucco aluminum, while the top layer of sheet metal 52 is preferably 14 gauge steel.

The breaker strips 36, 40 and 58 are loosely held to the adjoining sheet metal when assembling the cabinet 20. After the breaker strips are in place, the cabinet 20 is held in a form while foam is injected into the spaces between the sheet metal walls, as is common in the art, to provide the insulation layer 34. The foam solidifies and thus helps provide rigidity and strength to the cabinet 20, as well as firmly holding the breaker strips to the sheet metal.

The roof member 50 is preferably constructed by pre-drilling holes through the sheet metal layers 52 and 54 for the various lines that will run through the roof member 50, as well as threaded holes (not shown) for securing the various elements to the roof member 50. The breaker strip 58 is next positioned around the perimeter, the assembly is placed in a mold, and foam is injected into the space between layers 52 and 54 to create insulation layer 56. Nylon bolts, not shown, are preferably used to secure the evaporator 66 to the roof member 50. These nylon bolts extend through the insulation layer 56 and top sheet metal layer 52 as well as bottom sheet metal layer 54. Also, the roof member 50 is preferably equipped with handles 53 to help in placing the roof member 50 in the ledge 42 of the cabinet member 20.

The doors 22 are formed in a similar fashion, with sheet metal walls and a breaker strip. The doors 22 preferably include a bellows-type gasket for sealing the door opening when the doors 22 are closed. Preferably the door gasket includes a magnetic material, and a piece of iron or steel 33 (FIG. 5) is foamed in place behind the outside wall area surrounding the door openings to provide better magnetic attraction to hold the doors 22 closed.

Due to environmental concerns, the refrigeration system of the preferred embodiment preferably does not use R-12 refrigerant. The refrigerator versions have been developed so as to be able to use R-22 refrigerant, while the freezer versions use R-502 refrigerant. Suitable evaporators and compressor/condenser assemblies using these refrigerants have been determined for use with the various cabinet sizes. The preferred compressor/condensers are supplied by the Copeland Company of Sidney, Ohio and by Tecumseh Products Company of Tecumseh, Mich. The presently preferred evaporators are supplied by Heatcraft, Inc. of Wilmington, N.C. and by Bohn Heat Transfer of Danville, Ill. The preferred model numbers are listed below:

| | COMPRESSOR/ CONDENSER MODEL NUMBER | EVAPORATOR MODEL NUMBER |
|---|---|---|
| One-door refrigerator | MTYH-0025-IAA-102 | CCH-010 DK |
| One-door freezer | F3AF-A050-IAA-206 | TL-0120 |
| Two-door refrigerator | MTYH-0033-IAA-102 | CCH-017 DK |
| Two-door freezer | AJ2430 | CCL-028 D11 |
| Three-door refrigerator | F3AH-A050-IAA-206 | CCH-023 DK |
| Three-door freezer | F3AF-A075-IAV-206 | CCL-035 D33 |

The compressor model numbers are all Copeland models, except for the two-door freezer model number, which is a Tecumseh model number. The evaporator model numbers are all Heatcraft models, except for the one-door freezer model number, which is a Bohn model number.

The breaker strips are preferably extruded from PVC resin. The rigid portions of breaker strips 40 and 58 will preferably have a durometer of 90, and the flexible tip 44 and leg 60 portions will preferably have a durometer of 70.

The breaker strip 40 is preferably formed so that the sealing tip 44 and the portion of the breaker strip below ledge 42 form a cove, or corner 41 with a radius of at least 0.25 inches. Since this corner is one of the inside corners of the completed cabinet, NSF requires that the corner be radiused to allow for easy cleaning A ⅜ inch radius is preferred.

The pipe 81 is preferably stainless steel, while the drain tube 80 is preferably copper. The heater element 85 is preferably a calrod heater.

The layer of insulation 34 inside the walls of the cabinet 20 is preferably about 1⅞ inches thick, which is sufficient insulation for when the cabinet is used as a reach-in freezer.

The cabinet 20 is preferably equipped with adjustable shelves (not shown) as is common in the industry.

The preferred embodiment of the present invention provides a reach-in cooler with a window having an interchangeable refrigeration system allowing a distributor to stock components to provide immediate delivery of freezers or refrigerators without maintaining a large inventory of different cabinets. Assembly of a completed cooler is very simple, only requiring the placement of the roof assembly 50 into the open roof area of the cabinet 20 and connecting plug 112 into receptacle 99 and connecting wire 117 into plug 118 to energize wire 113 leading to the condensate evaporation pan heater 89. The window is sized to allow one to view the interior of the reach-in cooler while minimizing heat-loss. Also, the preferred embodiments described above have several other important advantages. The use of R-22 refrigerant provides an environmental advantage. The double air seals are simple yet assure that no air leaks into the cabinet where the interchangeable roof member is attached. The dual durometer PVC provides good seals without the use of silicone caulking, which has a tendency to absorb odors. Having the evaporator inside of the insulated cabinet provides better efficiency than having to circulate air outside of the cabinet into a separately insulated chamber housing an evaporator. The switch 96 on the refrigerator models allows for activation of the door heater wires 37 only when needed.

It should be appreciated that the present invention is capable of being incorporated in the form of a variety of embodiments, only a few of which have been illustrated and described above. The invention may be embodied in other forms without departing from its spirit or essential characteristics.

The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

We claim:

1. A combination of three members, two of which can be fit together to form a reach-in cooler that can be used as a refrigerator and two of which can be fit together to form a reach-in cooler that can be used as a freezer, the three members comprising:

a) an insulated cabinet member with walls having at least one door opening and a floor completing the cabinet body, but with an open roof area, the cabinet member constructed to be useable as both a refrigerator cabinet and a freezer cabinet; and b) two insulated roof members configured to close the open roof area of the cabinet, the first roof member comprising a refrigeration system sized to maintain refrigeration temperatures in the cabinet during normal commercial use and the second roof member comprising a refrigeration system sized to maintain freezing temperatures in the cabinet during normal commercial use, the first roof member used to close the one roof area of the cabinet when the reach-in cooler is to be used as a refrigerator and the second roof member used to close the open roof area of the cabinet when the reach-in cooler is to be used as a freezer.

2. The combination of claim 1, further comprising sealing means for providing an air tight seal between the cabinet member and the roof member used to close the pen roof area of the cabinet, the sealing means having a rigid part attached to one of either the cabinet member or the roof member and an integrally connected flexible part positioned to seal against the other of the cabinet member or the roof member.

3. The combination of claim 2 wherein the sealing means comprises double air seals.

4. The combination of claim 3 wherein the double air seals are provided by first and second dual durometer plastic members, each having a rigid part and a flexible part, the rigid part of the first plastic member being connected to the cabinet member and the flexible part of the first plastic member being biased to seal against the roof member, and the rigid part of the second plastic member being connected to the roof member and the flexible part of the second plastic member being biased to seal against the cabinet member.

5. The combination of claim 1 wherein the cabinet member further comprises one or more doors to provide a reach-in cooler having a cabinet selected from the group consisting of one-door, two-door, and three-door cabinets.

6. A method of assembling a reach-in cooler that can be used as both a refrigerant and a freezer, comprising the following steps:

a) providing an insulated cabinet member with walls having at least one door opening and a floor completing the cabinet body, but with an open roof area, the cabinet member constructed to be useable as both a refrigerator cabinet and a freezer cabinet;

b) providing two insulated roof members configured to close the open roof area of the cabinet, the first roof member comprising a refrigeration system sized to maintain refrigeration temperatures in the insulated cabinet during normal commercial use and the second roof member comprising a refrigeration system sized to maintain freezing temperatures in the insulated cabinet during normal commercial use;

c) selecting one of the two insulated roof members to close off the open roof area of the cabinet to form a refrigerator or a freezer reach-in cooler; and d) positioning roof member selected in step c) to close off the open roof area of the cabinet.

7. The method of assembling the reach-in cooler of claim 6, further comprising the step of providing sealing means for providing an air tight seal between the cabinet member provided in step a) and the roof member positioned in step d) to close off the open roof area of the cabinet.

8. The method of assembling the reach-in cooler of claim 7 wherein the sealing means comprises double air seals.

9. The method of assembling the reach-in cooler of claim 6 wherein the cabinet member provided in step a) further comprises one or more doors to provide a reach-in cooler having a cabinet selected from the group consisting of one-door, two-door, and three-door cabinets.

* * * * *

UNITED STATES PATENT AND TRADEMARK OFFICE

CERTIFICATE OF CORRECTION

PATENT NO. : 5,284,023
DATED : February 8, 1994
INVENTOR(S) : Robert K. Silva
and Kenneth L. Silva It is certified that error appears in the above-indentified patent and that said Letters Patent is hereby corrected as shown below:

In column 3, line 4, delete "FIG," and substitute -- FIG. -- therefor.

In column 3, line 37, delete "FIG." and substitute -- FIGS. -- therefor.

In claim 2, column 10, line 67, delete "pen" and substitute -- open -- therefor.

In claim 6, column 11, line 23, delete "refrigerant" and substitute -- refrigerator -- therefor.

Signed and Sealed this

Twenty-third Day of August, 1994

*Attest:*

Bruce Lehman

BRUCE LEHMAN

*Attesting Officer*

*Commissioner of Patents and Trademarks*